US008836733B2

(12) United States Patent
Lee et al.

(10) Patent No.: US 8,836,733 B2
(45) Date of Patent: Sep. 16, 2014

(54) GAMMA VOLTAGE CONTROLLER, GRADATION VOLTAGE GENERATOR, AND DISPLAY DEVICE INCLUDING THEM

(75) Inventors: Seung-Wook Lee, Yongin (KR); Sang-Min Lim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 330 days.

(21) Appl. No.: 13/087,162

(22) Filed: Apr. 14, 2011

(65) Prior Publication Data

US 2012/0162272 A1 Jun. 28, 2012

(30) Foreign Application Priority Data

Dec. 24, 2010 (KR) ..... 10-2010-0134884

(51) Int. Cl.
*G09G 5/10* (2006.01)

(52) U.S. Cl.
CPC ..... *G09G 5/10* (2013.01)
USPC ..... 345/690; 345/89

(58) Field of Classification Search
None
See application file for complete search history.

(56) References Cited

U.S. PATENT DOCUMENTS

| | | | | |
|---|---|---|---|---|
| 5,754,150 | A * | 5/1998 | Matsui | 345/89 |
| 2002/0101416 | A1* | 8/2002 | Woo et al. | 345/212 |
| 2002/0186230 | A1* | 12/2002 | Kudo et al. | 345/690 |
| 2004/0212632 | A1* | 10/2004 | Inada et al. | 345/690 |
| 2005/0007393 | A1* | 1/2005 | Akai et al. | 345/690 |
| 2005/0017960 | A1* | 1/2005 | Nishimura | 345/204 |
| 2006/0279498 | A1* | 12/2006 | Kaneda et al. | 345/89 |
| 2009/0096731 | A1 | 4/2009 | Woo et al. | |
| 2009/0189924 | A1* | 7/2009 | Ogura | 345/690 |
| 2009/0207122 | A1* | 8/2009 | Cheng et al. | 345/102 |
| 2010/0001984 | A1* | 1/2010 | Kim et al. | 345/212 |
| 2010/0103464 | A1 | 4/2010 | Takayama et al. | |
| 2010/0127960 | A1* | 5/2010 | Jung et al. | 345/89 |

FOREIGN PATENT DOCUMENTS

| | | |
|---|---|---|
| KR | 1993-0000680 | 1/1993 |
| KR | 19930000680 | 1/1993 |
| KR | 10-2009-0037695 | 4/2009 |
| KR | 20090037695 | 4/2009 |
| KR | 10-2010-0005515 | 1/2010 |
| KR | 20100005515 | 1/2010 |
| KR | 10-2010-0045917 | 5/2010 |
| KR | 20100045917 | 5/2010 |

OTHER PUBLICATIONS

Truly Semiconductors, Ltd. "TFT New Technology Introduction AFFS: Advanced Fringe Field Switching." www.trulydisplays.com/tft/AFFSTechnology.ppt, Jan. 10, 2011.

* cited by examiner

*Primary Examiner* — Amare Mengistu
*Assistant Examiner* — Yaron Cohen
(74) *Attorney, Agent, or Firm* — Robert E. Bushnell, Esq.

(57) ABSTRACT

The present invention relates to a gamma voltage controller, a gradation voltage generator, and a display device including them. The gamma voltage controller corrects luminance in high and low gradations according to a color mode of a display panel, and generates a plurality of gradation voltages through inflection point adjustment, thus minimizing gradation mismatch between color modes.

24 Claims, 9 Drawing Sheets

FIG. 8

| 16M (256 GRADATIONS) | | | 262K (64 GRADATIONS) | | | 65K (32 GRADATIONS) | | |
|---|---|---|---|---|---|---|---|---|
| GRADATION VOLTAGE | IMAGE DATA | GRADATION | GRADATION VOLTAGE | IMAGE DATA | GRADATION | GRADATION VOLTAGE | IMAGE DATA | GRADATION |
| V0 | 00000000 | 1 | V0 | 00000000 | 1 | V0 | 00000000 | 1 |
| V1 | 00000001 | 2 | V1 | 00000001 | | V1 | 00000001 | |
| V2 | 00000010 | 3 | V2 | 00000010 | | V2 | 00000010 | |
| V3 | 00000011 | 4 | V3 | 00000011 | | V3 | 00000011 | |
| V4 | 00000100 | 5 | V4 | 00000100 | 2 | V4 | 00000100 | |
| V5 | 00000101 | 6 | V5 | 00000101 | | V5 | 00000101 | |
| V6 | 00000110 | 7 | V6 | 00000110 | | V6 | 00000110 | |
| V7 | 00000111 | 8 | V7 | 00000111 | | V7 | 00000111 | |
| V8 | 00001000 | 9 | V8 | 00001000 | 3 | V8 | 00001000 | 2 |
| V9 | 00001001 | 10 | V9 | 00001001 | | V9 | 00001001 | |
| V10 | 00001010 | 11 | V10 | 00001010 | | V10 | 00001010 | |
| V11 | 00001011 | 12 | V11 | 00001011 | | V11 | 00001011 | |
| V12 | 00001100 | 13 | V12 | 00001100 | 4 | V12 | 00001100 | |
| V13 | 00001101 | 14 | V13 | 00001101 | | V13 | 00001101 | |
| V14 | 00001110 | 15 | V14 | 00001110 | | V14 | 00001110 | |
| V15 | 00001111 | 16 | V15 | 00001111 | | V15 | 00001111 | |
| ⋮ | ⋮ | ⋮ | ⋮ | ⋮ | ⋮ | ⋮ | ⋮ | ⋮ |
| V248 | 11111000 | 249 | V248 | 11111000 | 63 | V251 | 11111000 | 32 |
| V249 | 11111001 | 250 | V249 | 11111001 | | V252 | 11111001 | |
| V250 | 11111010 | 251 | V250 | 11111010 | | V253 | 11111010 | |
| V251 | 11111011 | 252 | V251 | 11111011 | | V251 | 11111011 | |
| V252 | 11111100 | 253 | V252 | 11111100 | 64 | V252 | 11111100 | |
| V253 | 11111101 | 254 | V253 | 11111101 | | V253 | 11111101 | |
| V254 | 11111110 | 255 | V254 | 11111110 | | V254 | 11111110 | |
| V255 | 11111111 | 256 | V255 | 11111111 | | V255 | 11111111 | |

GAMMA VOLTAGE CONTROLLER, GRADATION VOLTAGE GENERATOR, AND DISPLAY DEVICE INCLUDING THEM

CLAIM OF PRIORITY

This application makes reference to, incorporates the same herein, and claims all benefits accruing under 35 U.S.C. §119 from an application earlier filed in the Korean Intellectual Property Office on Dec. 24, 2010 and there duly assigned Serial No. 10-2010-0134884.

BACKGROUND OF THE INVENTION

1. Field of the Invention

The present invention relates to a gamma voltage controller, a gradation voltage generator, and a display device including them.

2. Description of the Related Art

A liquid crystal display (LCD) device displays images by adjusting light transmittances of liquid crystal cells according to a video signal. The LCD device displays an image by applying an analog gradation voltage to a pixel using a thin film transistor (TFT).

Generally, the LCD device adjusts a voltage gap between data voltages for display suitable for an LCD panel having unique gamma characteristics. Adjustment of the voltage gap is performed by a gradation voltage generator of the LCD device which adjusts the voltage gap between the data voltages by controlling a voltage level of each gradation voltage.

As such, the LCD device may output an image suitable for the liquid crystal panel having unique gamma characteristics by adjusting the voltage level of each gradation voltage. However, the gradation voltage generator included in the conventional LCD device has some limitation in adjusting the voltage level of each gradation voltage, such that the gradation voltage generator cannot output voltages required for various liquid crystal panels and thus is not applicable to various liquid crystal panels.

SUMMARY OF THE INVENTION

The present invention provides a display device capable of solving gradation mismatch between color modes.

According to an aspect of the present invention, a gamma voltage controller comprises: a gamma divider, a gamma selection unit, a gamma buffering unit, a mode selector, and a gradation controller. The gamma divider generates a plurality of voltages through voltage division between a first gradation voltage and an $N^{th}$ gradation voltage. The gamma selection unit includes first thru $M^{th}$ gamma selectors which select first thru $M^{th}$ gamma voltages from among the plurality of voltages and output the selected first thru $M^{th}$ gamma voltages. The gamma buffering unit buffers the first thru $M^{th}$ gamma voltages and outputs first thru $M^{th}$ gamma buffer voltages. The mode selector selects a color mode of a display panel. The gradation controller selects one of the first gamma buffer voltage and the first gradation voltage, and one of the $M^{th}$ gamma buffer voltage and the $N^{th}$ gradation voltage, and generates second thru $(N-1)^{th}$ gradation voltages to compensate for luminance in high gradations and luminance in low gradations according to the selected color mode.

The gradation controller may include a switch and a gradation divider. The switch blocks the first gamma buffer voltage and the $M^{th}$ gamma buffer voltage, and outputs the first gradation voltage and the $N^{th}$ gradation voltage. The gradation divider generates the second thru $(N-1)^{th}$ gradation voltages by using the first gradation voltage and the $N^{th}$ gradation voltage.

The switch may block some of the first thru $M^{th}$ gamma buffer voltages if a color mode of a lower gradation than a color mode of a gradation set by default is selected.

The gamma voltage controller may further include first thru $M^{th}$ inflection point adjustment switches which adjust an inflection point of a gamma curve by selecting a connection point with the gradation divider.

According to another aspect of the present invention, a gradation voltage generator comprises a reference voltage selector, a gradation voltage selector, and a gamma voltage controller. The reference voltage selector selects a maximum reference voltage and a minimum reference voltage from among a plurality of voltages divided between a first power voltage and a second power voltage, and outputs the selected maximum reference voltage and minimum reference voltage. The gradation voltage selector outputs a first gradation voltage as the maximum reference voltage and an $N^{th}$ gradation voltage as the minimum reference voltage. The gamma voltage controller selects first thru $M^{th}$ gamma voltages from among a plurality of voltages generated by voltage division between the first gradation voltage and the $N^{th}$ gradation voltage, selects one of a first gamma buffer voltage and the first gradation voltage, and one of an $M^{th}$ gamma buffer voltage and the $N^{th}$ gradation voltage, and generates second thru $(N-1)^{th}$ gradation voltages to compensate for luminance in high gradations and luminance in low gradations according to a color mode of a display panel.

According to another aspect of the present invention, a display device comprises a display panel, a source driver, and a gradation voltage generator. The source driver is connected to a plurality of data lines of the display panel, and supplies a data voltage to the plurality of data lines. The gradation voltage generator generates a first gradation voltage and an $N^{th}$ gradation voltage based on a first power voltage and a second power voltage, generates second thru $(N-1)^{th}$ gradation voltages based on first thru $M^{th}$ gamma voltages generated by voltage division between the first gradation voltage and the $N^{th}$ gradation voltage, corrects luminance in high gradations and luminance in low gradations according to a color mode of the display panel, and provides the first thru $N^{th}$ gradation voltages to the source driver.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein:

FIG. 8 is a diagram showing a match relationship between gradation voltages and image data bits of a memory according to color modes.

DETAILED DESCRIPTION OF THE INVENTION

Figure 1:
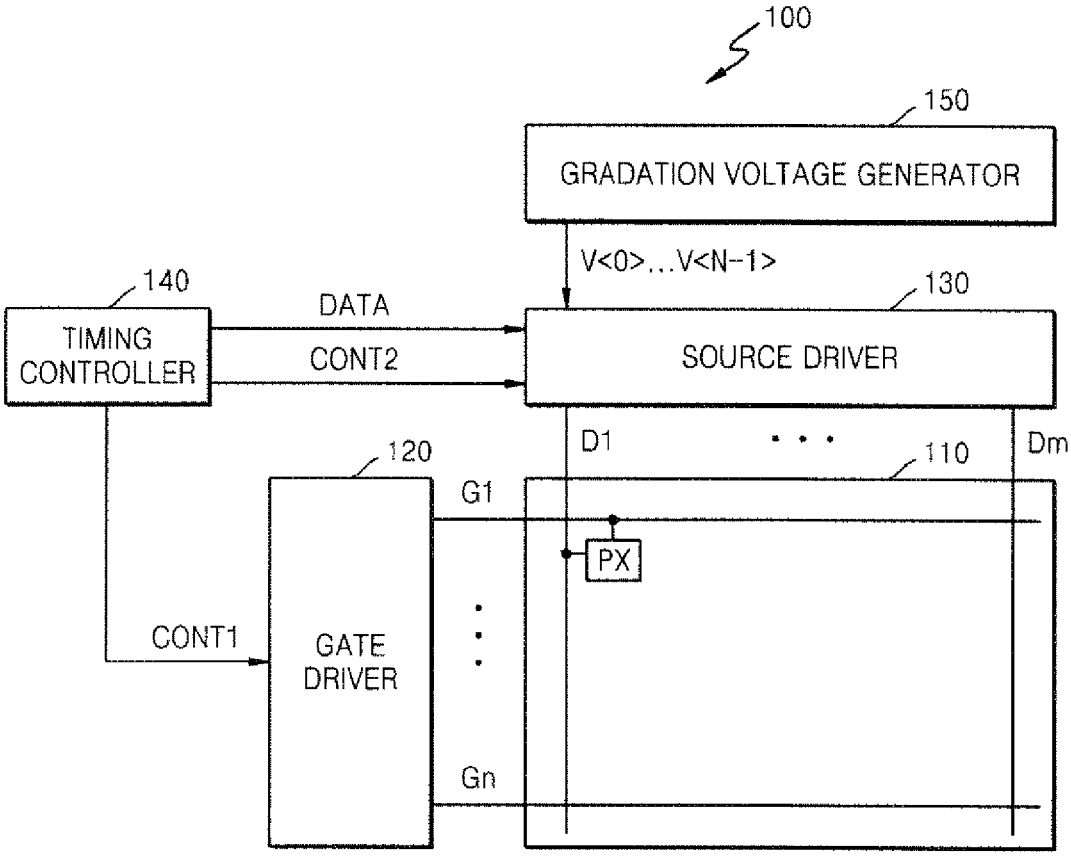
FIG. 1 is a block diagram showing a display apparatus according to an embodiment of the present invention.

Hereinafter, exemplary embodiments of the present invention will be described with reference to the accompanying drawings. Like reference numerals denote like elements throughout the specification. A detailed description of known functions and configurations will be omitted when it may unnecessarily obscure the subject matter of the present invention.

It will be understood that, although the terms first, second, third, etc. may be used herein to describe various components, these components should not be limited by these terms. These terms are only used to distinguish one component from another component. Thus, a first component discussed below could be termed a second component without departing from the teachings of exemplary embodiments.

The terminology used herein is for the purpose of describing particular embodiments only and is not intended to be limiting of exemplary embodiments. As used herein, the singular forms "a," "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the exemplary embodiments pertain. It will be further understood that terms, such as those defined in commonly used dictionaries, should be interpreted as having a meaning that is consistent with their meaning in the context of the relevant art, and should not be interpreted in an idealized or overly formal sense unless expressly so defined herein.

Figure 2:
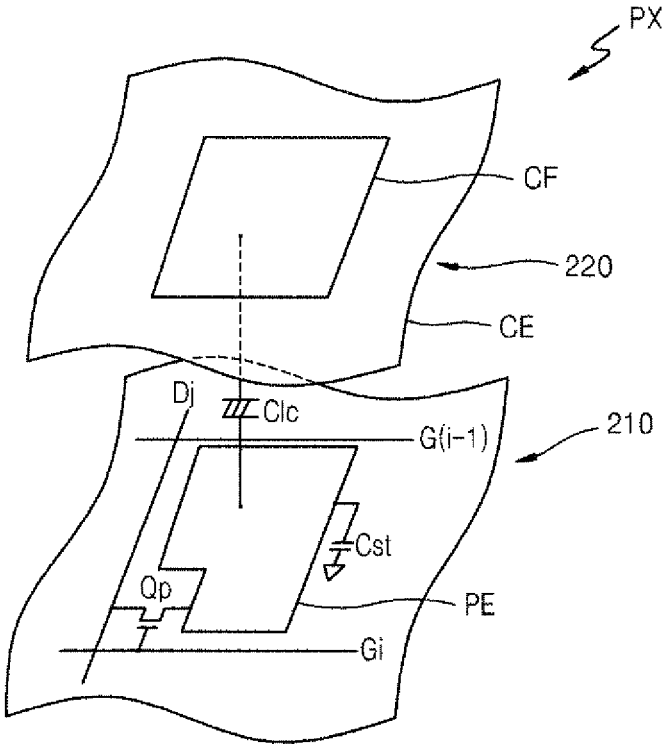
FIG. 2 is a diagram schematically showing the structure of a pixel according to an embodiment of the present invention.

FIG. 1 is a block diagram showing a display apparatus according to an embodiment of the present invention, and FIG. 2 is a diagram schematically showing the structure of a pixel according to an embodiment of the present invention.

Referring to FIG. 1, a liquid crystal display (LCD) device 100 according to an embodiment of the present invention includes a liquid crystal panel 110, a gate driver 120, a source driver 130, a timing controller 140, and a gradation voltage generator 150.

The LCD device 100 provides a plurality of gradation voltages V<0> thru V<N−1> to the source driver 130 by using the gradation voltage generator 150, applies a data voltage Vd to a plurality of data lines D1 thru Dm of the liquid crystal panel 110 by using the source driver 130, and applies a gate voltage Vg to a plurality of gate lines G1 thru Gn of the liquid crystal panel 110 by using the gate driver 120, thus driving the liquid crystal panel 110. By using the timing controller 140, a gate control signal CONT1 and a data control signal CONT2 are provided to the gate driver 120 and the source driver 130, respectively, thereby controlling the gate driver 120 and the source driver 130.

The liquid crystal panel 110 includes the plurality of gate lines G1 thru Gn, the plurality of data lines D1 thru Dm, and a plurality of pixels PX. The plurality of gate lines G1 thru Gn are arranged in rows spaced apart at predetermined intervals so as to deliver the gate voltage Vg therethrough. The plurality of data lines D1 thru Dm are arranged in columns spaced apart at predetermined intervals so as to deliver the data voltage Vd. The plurality of gate lines G1 thru Gn and the plurality of data lines D1 thru Dm are arranged in a matrix form, in which each pixel PX is formed at an intersection between a gate line and a data line.

The pixel PX shown in FIG. 1 will be described with reference to FIG. 2. The liquid crystal panel 110 is formed by including a liquid crystal layer (not shown) between a first substrate 210 and a second substrate 220. On the first substrate 210, the plurality of gate lines G1 thru Gn, the plurality of data lines D1 thru Dm, a pixel switching device Qp, and a pixel electrode PE are formed. On the second substrate 220, a color filter CF and a common electrode CE are formed. Unlike what is shown in FIG. 2, the color filter CF may be provided above or under the pixel electrode PE of the first substrate 210.

For example, a pixel PX connected to an ith gate line Gi and a jth data line Dj includes: a pixel switching device Qp, which includes a gate electrode connected to the gate line Gi, a first electrode connected to the data line Dj, and a second electrode connected to the pixel electrode PE; and a liquid crystal capacitor Clc and a storage capacitor Cst coupled to the second electrode of the pixel switching device Qp through the pixel electrode PE. Herein, i is a natural number greater than 1 and less than n, and j is a natural number greater than 1 and less than m.

The liquid crystal capacitor Clc is formed so as to have two electrodes, the pixel electrode PE of the first substrate 210 and the common electrode CE of the second substrate 220, and it includes a liquid crystal layer between the two electrodes as a dielectric. A common voltage Vcom is applied to the common electrode CE. According to a voltage applied to the pixel electrode PE, the light transmittance of the liquid crystal layer is adjusted, thus adjusting the luminance of each pixel PX.

The pixel electrode PE may be coupled to the data line Dj through the pixel switching device Qp. The pixel switching device Qp is connected at the gate electrode thereof to the gate line Gi such that, upon application of a gate-on voltage Von to the gate line Gi, the pixel switching device Qp is turned on so as to apply the data voltage Vd, delivered through the data line Dj, to the pixel electrode PE.

The storage capacitor Cst is formed such that the pixel electrode PE and a separate signal line (not shown), formed on the first substrate 210 in parallel with the gate line Gi, (e.g., a storage line), overlap with each other with an insulating material therebetween. The common voltage Vcom or a predetermined voltage for the storage capacitor Cst may be applied to the separate signal line.

The pixel switching device Qp may be a thin film transistor (TFT) formed of amorphous silicon.

Referring back to FIG. 1, the gate driver 120 generates the gate voltage Vg which is a combination of the gate-on voltage of an active level and a gate-off voltage Voff of an inactive level, and sequentially supplies the gate voltage Vg to the liquid crystal panel 110 through the plurality of gate lines G1 thru Gn.

The source driver 130 selects a gradation voltage corresponding to input image data DATA inputted by the timing controller 140 from among the plurality of gradation voltages V<0> thru V<N−1> inputted by the gradation voltage generator 150, and outputs the selected gradation voltage to the liquid crystal panel 110.

The timing controller 140 is provided with the input image data DATA and an input control signal for controlling display of the input image data DATA from an external graphic controller (not shown). The input control signal may include a horizontal sync signal Hsync, a vertical sync signal Vsync, and a main clock MCLK. The timing controller 140 delivers the input image data DATA to the source driver 130, generates the gate control signal CONT1 and the data control signal CONT2, and delivers the gate control signal CONT1 and the data control signal CONT2 to the gate driver 120 and the source driver 130, respectively. The gate control signal CONT1 includes a scan start signal, instructing start of scanning, and a plurality of clock signals, and the data control signal CONT2 includes a horizontal sync start signal instructing delivery of the input image data DATA for pixels PX in a row, and a clock signal.

The gradation voltage generator 150 selects a maximum reference voltage MAXRV and a minimum reference voltage MINRV among a plurality of voltages divided between a first power voltage VDD and a second power voltage VSS, and selects the maximum reference voltage MAXRV as the first gradation voltage V<0> or the $N^{th}$ gradation voltage V<N−1>, and the minimum reference voltage MINRV as the $N^{th}$ gradation voltage V<N−1> or the first gradation voltage V<0>. Thereafter, the gradation voltage generator 150 determines a gamma curve by selecting first thru $M^{th}$ gamma voltages from among the plurality of voltages generated by voltage division between the first gradation voltage V<0> and the $N^{th}$ gradation voltages V<N−1>, fixes or adjusts an inflection point of the gamma curve so as to generate second thru $(N-1)^{th}$ gradation voltages V<1> thru V<N−2>, and outputs the first thru $N^{th}$ gradation voltages V<0> thru V<N−1> to the source driver 130. In this way, the LCD device 100 can output a wide range of voltages required for various types of the liquid crystal panel 110 by including the gradation voltage generator 150 capable of determining the gamma curve and adjusting the inflection point of the determined gamma curve. In addition, the gradation voltage generator 150 compensates for luminance degradation in high and low gradations during driving of the liquid crystal panel 110 in a low-gradation color mode, thus implementing multi-gradations. The number of gradations is determined by the number of bits of digital data, and the LCD device 100 expresses a gradation with an i multiplication of 2 based on i-bit data.

Figure 3:
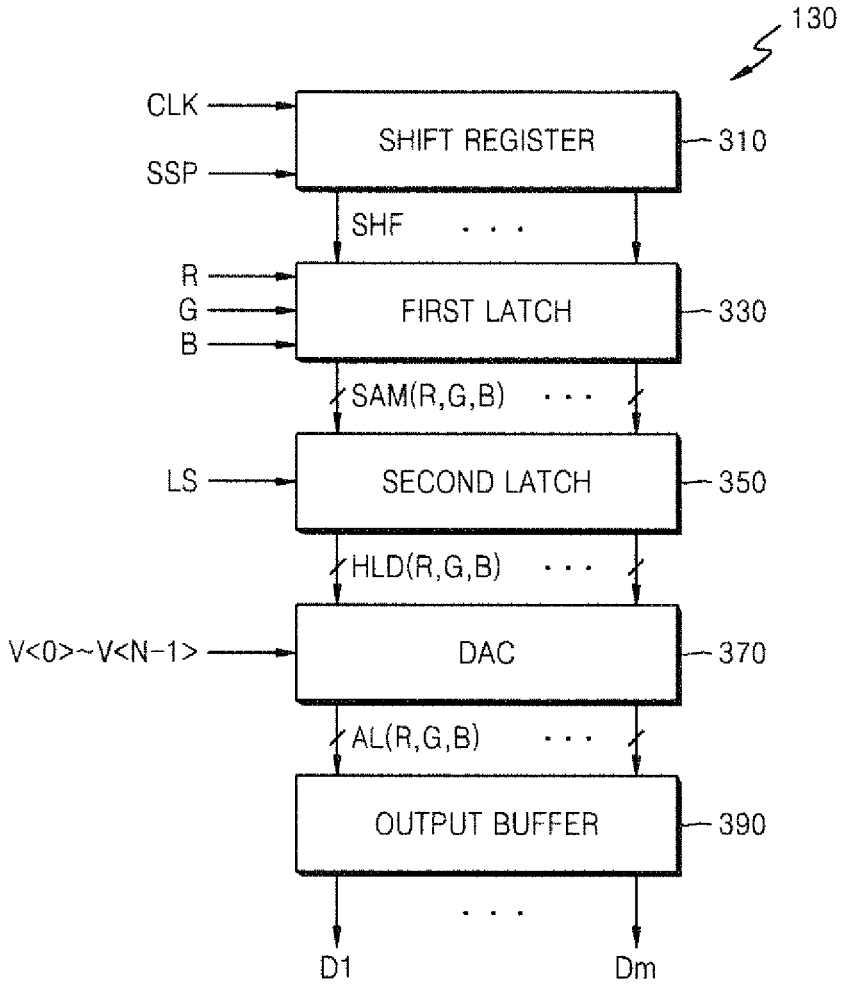
FIG. 3 is a block diagram schematically showing the internal structure of a source driver according to an embodiment of the present invention.

FIG. 3 is a block diagram schematically showing the internal structure of a source driver according to an embodiment of the present invention.

Referring to FIG. 3, the source driver 130 according to an embodiment of the present invention includes a shift register 310, a first latch 330, a second latch 350, a digital-to-analog converter (DAC) 370, and an output buffer 390.

The shift register 310 is provided to correspond to each data line, and includes a plurality of flip-flops sequentially connected in series. In the shift register 310, each flip-flop sequentially shifts a source start pulse SSP to its neighboring flip-flop in synchronization with the clock signal CLK, thus outputting a shift pulse signal SHF.

Digital RGB data is inputted to the first latch 330 which samples (SAM) the digital RGB data in synchronization with the shift pulse signal SHF outputted by each flip-flop of the shift-register 310 and stores the sampled digital RGB data.

The second latch 350 holds (HLD) the sampled digital RGB data, stored in the first latch 330, in synchronization with a latch signal LS.

The DAC 370 converts the digital RGB data output from the second latch 350 into analog RGB data AL based on the gradation voltages V<0> thru V<N−1> provided by the gradation voltage generator 150.

The output buffer 390 buffers the analog RGB data AL of the DAC 370 so as to output the buffered analog RGB data AL to the data lines DL1 thru DLm. The output buffer 390 includes an operation amplification circuit (OPC) provided for each data line, and each OPC impedance-converts the analog RGB data AL of the DAC 370 so as to output it to each data line.

Figure 4:
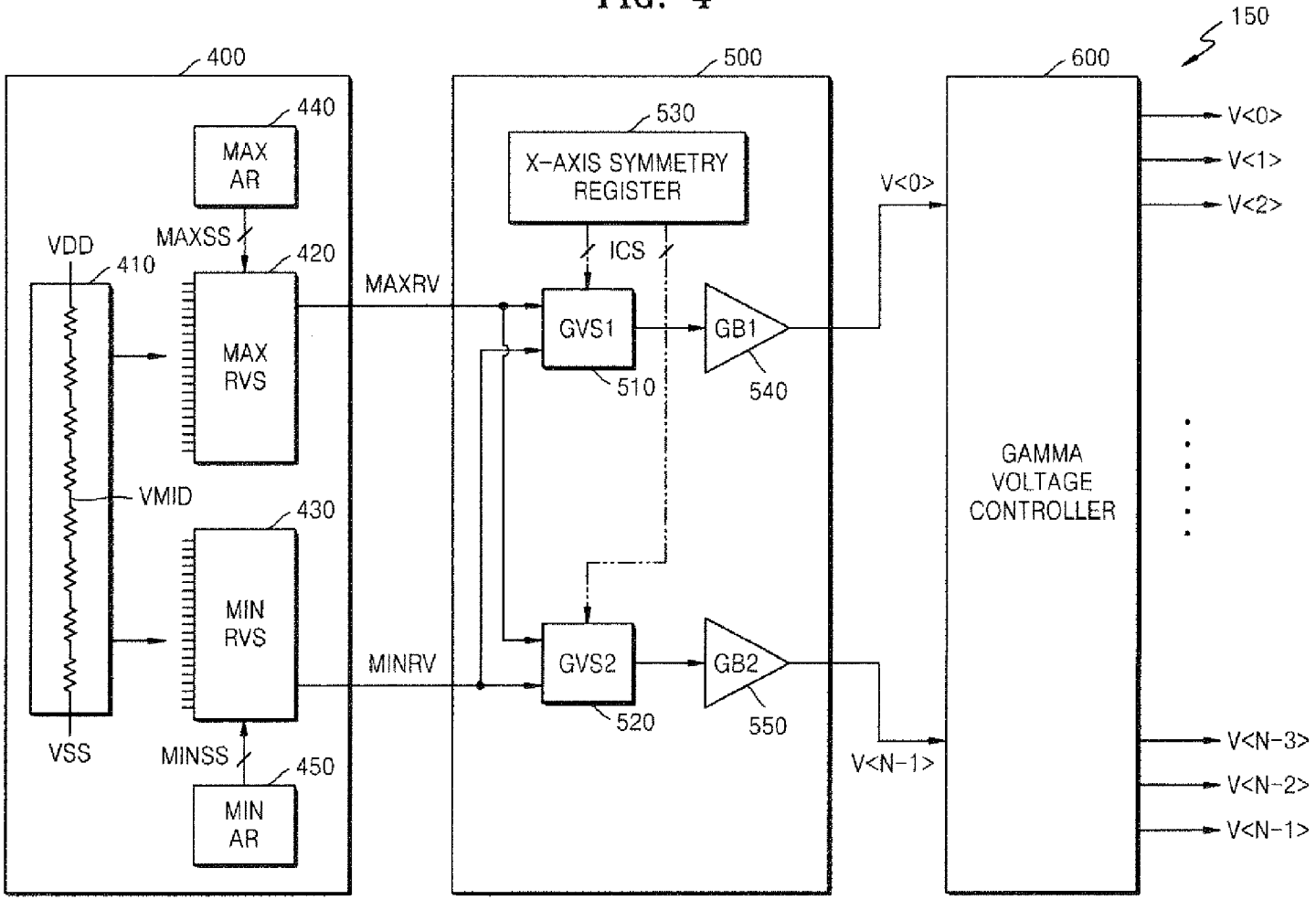
FIG. 4 is a block diagram schematically showing the internal structure of a gradation voltage generator according to an embodiment of the present invention.

FIG. 4 is a block diagram schematically showing the internal structure of a gradation voltage generator according to an embodiment of the present invention.

Referring to FIG. 4, the gradation voltage generator 150 includes a reference voltage selector 400, a gradation voltage selector 500, and a gamma voltage controller 600.

The reference voltage selector 400 selects the maximum reference voltage MAXRV and the minimum reference voltage MINRV from among the plurality of voltages divided between the first power voltage VDD and the second power voltage VSS, and outputs the selected voltages to the gradation voltage selector 500. The reference voltage selector 400 includes a power divider 410, a maximum reference voltage selector (MAX RVS) 420, a minimum reference voltage selector (MIN RVS) 430, a maximum adjustment register (MAX AR) 440, and a minimum adjustment register (MIN AR) 450.

The power divider 410 may include a resistor string and generates the plurality of voltages through voltage division between the first power voltage VDD and the second power voltage VSS. The maximum reference voltage selector 420 selects the maximum reference voltage MAXRV from among the first power voltage VDD through a middle voltage VMID in response to a maximum reference voltage signal MAXSS output from the maximum adjustment register 440, and outputs the maximum reference voltage MAXRV. Likewise, the minimum reference voltage selector 430 selects the minimum reference voltage MINRV among the middle voltage VMID through the second power voltage VSS in response to a minimum reference voltage signal MINSS output from the minimum adjustment register 450, and outputs the minimum reference voltage MINRV. The maximum adjustment register 440 outputs the maximum reference voltage signal MAXSS to the maximum reference voltage selector 420 through a level shifter so as to control selection of the maximum reference voltage MAXRV by the maximum reference voltage selector 420, and the minimum adjustment register 450 outputs the minimum reference voltage signal MINSS to the minimum reference voltage selector 430 through a level shifter so as to control selection of the minimum reference voltage MINRV by the minimum reference voltage selector 430.

The gradation voltage selector 500 outputs the maximum reference voltage MAXRV output from the reference voltage selector 400 as the first gradation voltage V<0> and the minimum reference voltage MINRV output from the reference voltage selector 400 as the $N^{th}$ gradation voltage V<N−1>, or outputs the minimum reference voltage MINRV output from the reference voltage selector 400 as the first gradation voltage V<0> and the maximum reference voltage MAXRV output from the reference voltage selector 400 as the $N^{th}$ gradation voltage V<N−1>. To perform such an operation, the gradation voltage selector 500 includes a first gradation voltage selector (GVS1) 510, a second gradation voltage selector (GVS2) 520, an X-axis symmetry register 530, a first gradation buffer (GB1) 540, and a second gradation (GB2) 550.

The first gradation voltage selector 510 outputs the maximum reference voltage MAXRV or the minimum reference voltage MINRV as the first gradation voltage V<0> in response to an inversion control signal ICS. The second gradation voltage selector 520 outputs the minimum reference voltage MINRV or the maximum reference voltage MAXRV as the $N^{th}$ gradation voltage V<N−1> in response to the inversion control signal ICS. The X-axis symmetry register 530 outputs the inversion control signal ICS to the first gradation voltage selector 510 and the second gradation voltage selector 520 through a level shifter so as to control selection performed by the first gradation voltage selector 510 and selection performed by the second gradation voltage selector 520. The first gradation buffer 540 buffers the first gradation voltage V<0> output from the first gradation voltage selector 510 so as to output the buffered first gradation voltage V<0> to a gamma voltage controller 600, and the second gradation buffer 550 buffers the $N^{th}$ voltage V<N−1> output from the second gradation voltage selector 520 so as to output the buffered $N^{th}$ voltage V<N−1> to the gamma voltage controller 600.

The gamma voltage controller 600 selects first thru $M^{th}$ gamma voltages GV_1 thru GV_M from among the plurality of voltages generated by voltage division between the first gradation voltage V<0> and the $N^{th}$ gradation voltage V<N−1>, generates second thru $(N-1)^{th}$ gradation voltages V<1> thru V<N−2> from the first thru $M^{th}$ gamma voltages GV_1 thru GV_M by fixing the inflection point of the gamma curve, and outputs the generated second thru $(N-1)^{th}$ gradation voltages V<1> thru V<N−2>. In another embodiment, the gamma voltage controller 600 may generate the second thru $(N-1)^{th}$ gradation voltages V<1> thru V<N−2> from the first thru $M^{th}$ gamma voltages GV_1 thru GV_M by adjusting the inflection point of the gamma curve. To correct luminance in high and low gradations according to the selected color mode, the gamma voltage controller 600 selects one of a first gamma buffer voltage AGV_1 and the first gradation voltage V<0> and one of an $M^{th}$ gamma buffer voltage AGV_M and the $N^{th}$ gradation voltage V<N−1>, thus generating the second thru $(N-1)^{th}$ gradation voltages V<1> thru V<N−2>.

Figure 5:
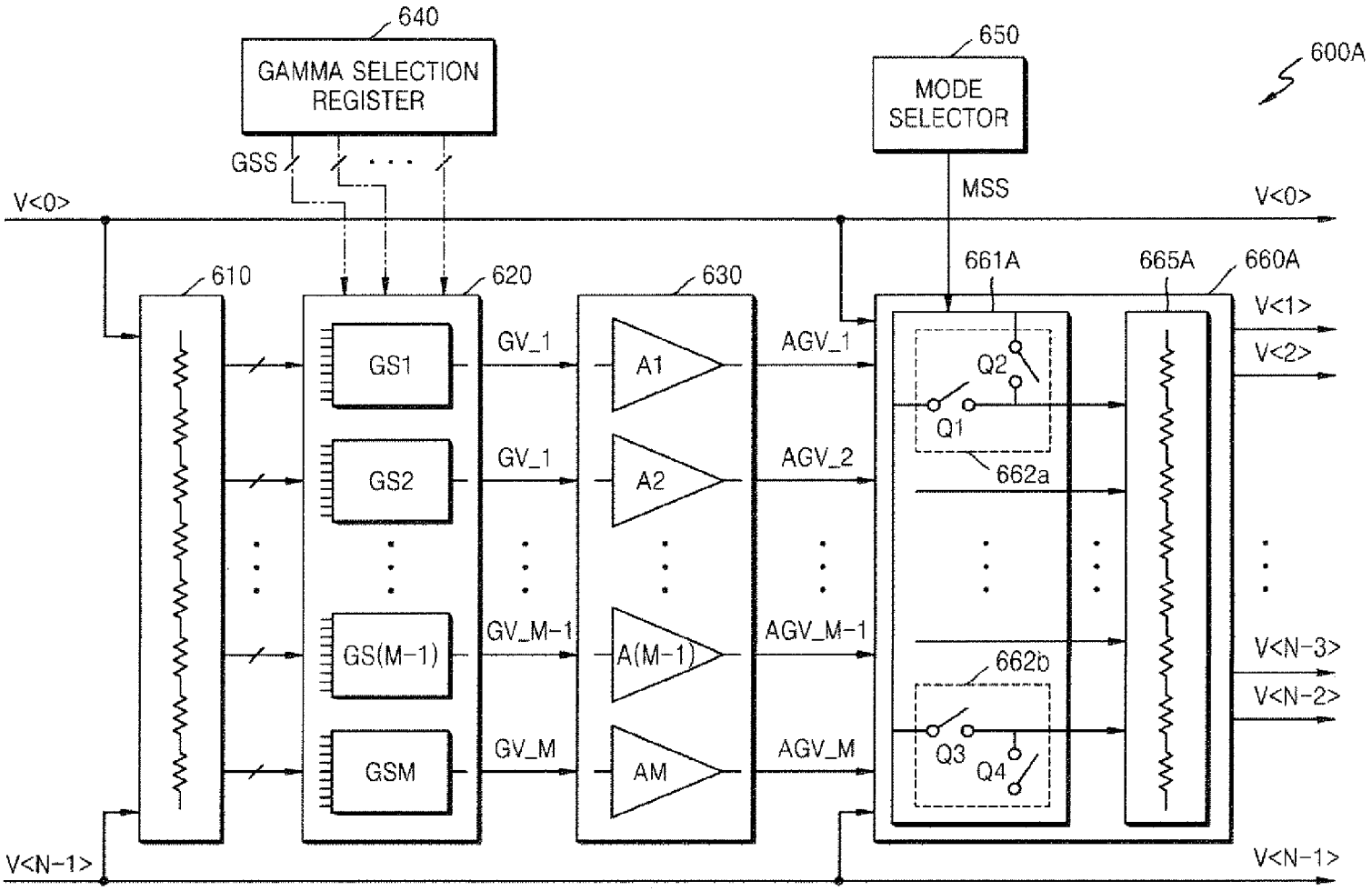
FIG. 5 is a block diagram schematically showing the internal structure of a gamma voltage controller according to an embodiment of the present invention.

FIG. 5 is a block diagram schematically showing the internal structure of a gamma voltage controller according to an embodiment of the present invention.

Referring to FIG. 5, the gamma voltage controller 600A may include a gamma divider 610, a gamma selection unit 620, a gamma buffering unit 630, a gamma selection register 640, a mode selector 650, and a gradation controller 660A.

The gamma divider 610 may include a resistor string, and generates the plurality of voltages through voltage division between the first gradation voltage V<0> and the $N^{th}$ gradation voltage V<N−1>, in which N is an integer greater than 2.

The gamma selection unit 620 includes first thru $M^{th}$ gamma selectors GS1 thru GSM which select and output the first thru $M^{th}$ gamma voltages GV_1 thru GV_M from among the plurality of voltages generated by the gamma divider 610 in response to first thru $M^{th}$ gamma selection signals GSS, respectively. Herein, M is a positive integer less than N. For example, when 256 gradation voltages are outputted, the gamma selection unit 620 may include the first gamma selector GS1 thru an eleventh gamma selector GS11 which select and output the first gamma voltage GV_1 thru an eleventh gamma voltage GV_11 from among a plurality of voltages generated by voltage division between the first gradation voltage V<0> and a $256^{th}$ gradation voltage V<255> in response to the first gamma selection signal GSS_1 thru an eleventh gamma selection signal GSS_11, respectively. The number of gamma selectors GS included in the gamma selection unit 620 may vary according to the number of output gradation voltages V<0> thru V<N−1>.

The first thru $M^{th}$ gamma voltages GV_1 thru GV_M outputted from the first thru $M^{th}$ gamma selectors GS1 thru GSM of the gamma selection unit 620 are inputted to the gamma buffering unit 630 which then buffers the first thru $M^{th}$ gamma voltages GV_1 thru GV_M and outputs first thru $M^{th}$ gamma buffer voltages AGV_1 thru AGV_M to the gradation controller 660A. Gamma buffers included in the gamma buffering unit 630 include a plurality of voltage followers for stabilized voltage provisioning, and the number of gamma buffers included in the gamma buffering unit 630 may vary according to the number of output gradation voltages V<0> thru V<N−1>. Connection points between output lines of the gamma buffering unit 630 and the gradation controller 660A are fixed.

The gamma selection register 640 outputs the first thru $M^{th}$ gamma selection signals GSS for controlling the first thru $M^{th}$ gamma selectors GS1 thru GSM of the gamma selection unit 620 to the first thru $M^{th}$ gamma selectors GS1 thru GSM through respective level shifters.

The mode selector 650 selects a color mode of the liquid crystal panel 110, and outputs a mode selection signal MSS to the gradation controller 660A. The color mode may include a 16M color mode expressed with 256 gradations, a 262K color mode expressed with 64 gradations, and a 65K color mode expressed with 32 gradations, and the color mode may be changed by the user's selection.

The gradation controller 660A generates and outputs the second thru $(N-1)^{th}$ gradation voltages V<1> thru V<N−2> through voltage division between the first gamma buffer voltage AGV_1 and the $M^{th}$ gamma buffer voltage AGV_M output from the gamma buffers. Positions of connection points between output lines of the gamma buffering unit 630 and the gradation controller 660A are fixed, and the gradation voltages are outputted based on the positions of the connection points. The gradation controller 660A corrects luminance of high and low gradations according to the mode control signal MSS output from the mode selector 650.

The gradation controller 660A includes a luminance corrector 661A and a gradation divider 665A.

The luminance corrector 661A corrects luminance in high and low gradations when the LCD device 100 is implemented with a color mode of a lower gradation than a particular gradation of a color mode set by default. For example, in the LCD device 100 which is set to 256 gradations (16M color mode) by default, in order to display data of 64 gradations (262K color mode) or 32 gradations (65K color mode), the luminance corrector 661A short-circuits the output line for the lowest gradation voltage V<0> with the output lines of one or more low-level gamma buffer voltages AGV_1, AGV_2, and the like, and short-circuits the output line for the highest gradation voltage V<255> with the output lines of one or more high-level gamma buffer voltages AGV_M, AGV_M−1, and the like.

The luminance corrector 661A includes a first switch 662*a* and a second switch 662*b*. While the first switch 662*a* connected to the output line for the first gamma buffer voltage AGV_1 and the second switch 662*b* connected to the output line for the $M^{th}$ gamma buffer voltage AGV_M will be described in the embodiment of FIG. 5 for the sake of convenience, it goes without saying that the present invention may further include switches connected to the output line for the second gamma buffer voltage AGV_2 through the output line for the $(M-1)^{th}$ gamma buffer voltage AGV_M−1 according to an expressible gradation type.

The first switch 662*a* corrects luminance in low gradations. The first switch 662*a* includes a switch element Q1 connected to the output line for the first gamma buffer voltage AGV_1 outputted by the gamma buffering unit 630, and a switch element Q2 connected between the output line for the first gamma buffer voltage AGV_1 and the output line for the first gradation voltage V<0>.

Once the switch element Q1 is turned on and the switch element Q2 is turned off, the first gamma butter voltage AGV_1 is outputted to the gradation divider 665A so as to generate the second gradation voltage V<1>. If the switch element Q1 is turned off and the switch element Q2 is turned on in low-gradation implementing color modes, the first gradation voltage V<0> is outputted to the gradation divider 665A so as to generate the second gradation voltage V<1>.

The second switch 662*b* corrects luminance in high gradations. The second switch 662*b* includes a switch element Q3 connected to the output line for the $M^{th}$ gamma buffer voltage AGV_M outputted from the gamma buffering unit 630, and a switch element Q4 connected between the output line for the $M^{th}$ gamma buffer voltage AGV_M and the output line for the $256^{th}$ gradation voltage V<255>. Once the switch element Q3 is turned on and the switch element Q4 is turned off, the $M^{th}$ gamma buffer voltage AGV_M is outputted to the gradation divider 665A so as to generate the $255^{th}$ gradation voltage V<254>. If the switch element Q3 is turned off and the switch element Q4 is turned on, the $256^{th}$ gradation voltage V<255> is outputted to the gradation divider 665A so as to generate a $255^{th}$ gradation voltage V<254>.

The gradation divider 665A includes a resistor string and generates the second thru $255^{th}$ gradation voltages V<1> thru V<254> through voltage division between the first gamma buffer voltage AGV_1 (or the first gradation voltage V<0>) and the $M^{th}$ gamma buffer voltage AGV_M (or the $256^{th}$ gradation voltage V<255>).

Figure 6:
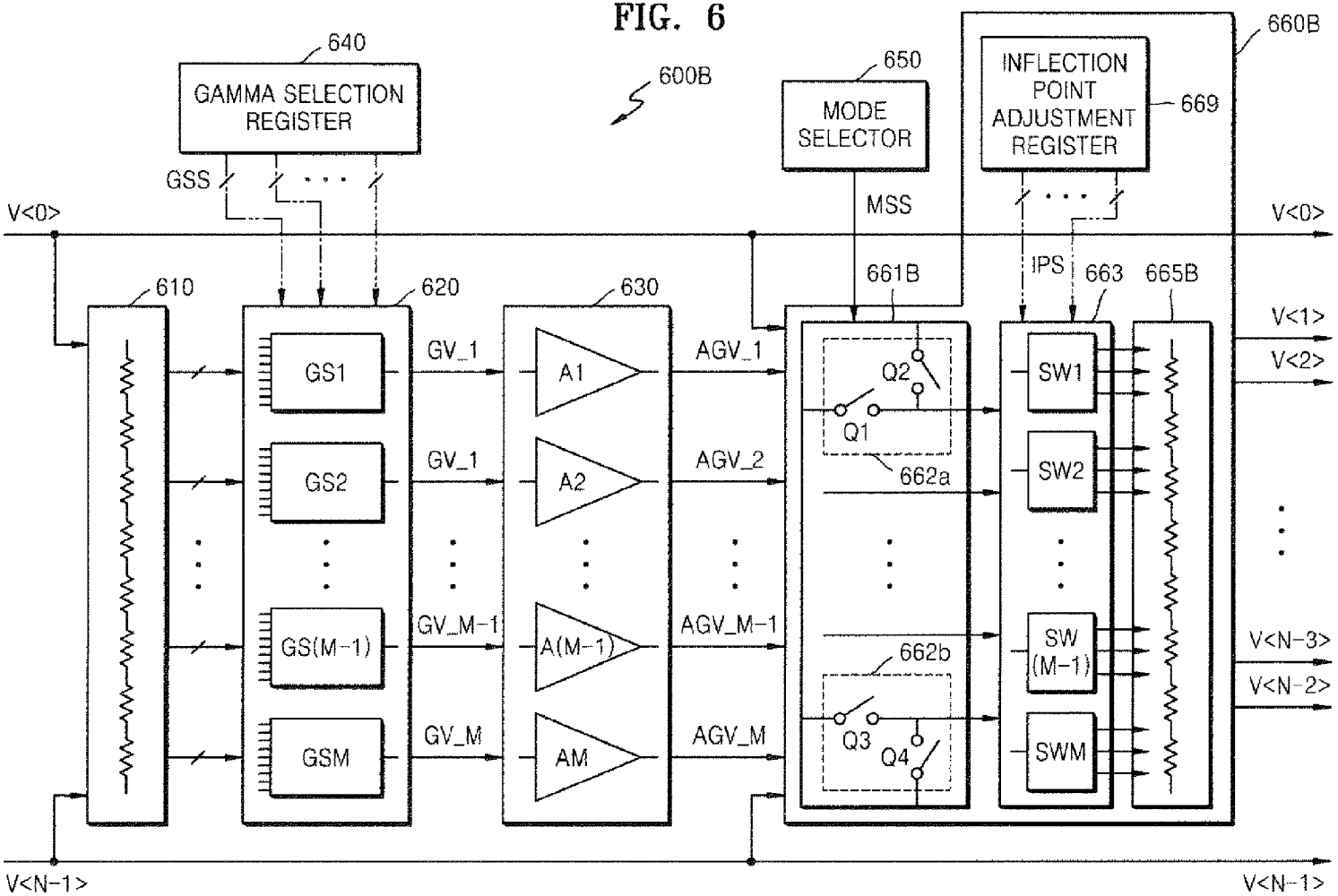
FIG. 6 is a block diagram schematically showing the internal structure of a gamma voltage controller according to another embodiment of the present invention.

FIG. 6 is a block diagram schematically showing the internal structure of a gamma voltage controller according to another embodiment of the present invention.

Referring to FIG. 6, the gamma voltage controller 600B may include the gamma divider 610, the gamma selection unit 620, the gamma buffering unit 630, the gamma selection register 640, the mode selector 650, and a gradation controller 660B.

The gamma voltage controller 600B of FIG. 6 is different from the gamma voltage controller 600A of FIG. 5 in light of the structure of the gradation controller 660B. Other components are the same as those described with reference to FIG. 5, and thus will not be described in detail.

The gradation controller 660B may include a luminance corrector 661B, an inflection point adjustment circuit 663, a gradation divider 665B, and an inflection point adjustment register 669.

The luminance corrector 661B corrects luminance in high and low gradations when the liquid crystal panel 110 is implemented with a color mode of a lower gradation than a particular gradation of a color mode set by default. For example, in the LCD device 100 which is set to 256 gradations (16M color mode) by default, in order to display data of 64 gradations (262K color mode) or 32 gradations (65K color mode), the luminance corrector 661B short-circuits the output line for the lowest gradation voltage V<0> with the output lines of one or more low-level gamma buffer voltages AGV_1, AGV_2, and the like, and short-circuits the output line for the highest gradation voltage V<255> with the output lines of one or more high-level gamma buffer voltages AGV_M, AGV_M−1, and the like.

The luminance corrector 661B includes the first switch 662*a* and the second switch 662*b*. While the first switch 662*a* connected to the output line for the first gamma buffer voltage AGV_1 and the second switch 662*b* connected to the output line for the $M^{th}$ gamma buffer voltage AGV_M will be described in the embodiment of FIG. 6 for the sake of convenience, it goes without saying that the present invention may further include switches connected to the output line for the second gamma buffer voltage AGV_2 through the output line for the $(M-1)^{th}$ gamma buffer voltage AGV_M−1 according to an expressible gradation type.

The first switch 662*a* corrects luminance in low gradations. The first switch 662*a* includes the switch element Q1 connected to the output line for the first gamma buffer voltage AGV_1 outputted by the gamma buffering unit 630, and the switch element Q2 connected between the output line for the first gamma buffer voltage AGV_1 and the output line for the first gradation voltage V<0>. Once the switch element Q1 is turned on and the switch element Q2 is turned off, the first gamma butter voltage AGV_1 is outputted to the gradation divider 665B so as to generate the second gradation voltage V<1>. If the switch element Q1 is turned off and the switch element Q2 is turned on in low-gradation implementing color modes, the first gradation voltage V<0> is outputted to the gradation divider 665B so as to generate the second gradation voltage V<1>.

The second switch 662*b* corrects luminance in high gradations. The second switch 662*b* includes the switch element Q3 connected to the output line for the $M^{th}$ gamma buffer voltage AGV_M output from the gamma buffering unit 630, and the switch element Q4 connected between the output line for the $M^{th}$ gamma buffer voltage AGV_M and the output line for the $256^{th}$ gradation voltage V<255>. Once the switch element Q3 is turned on and the switch element Q4 is turned off, the $M^{th}$ gamma buffer voltage AGV_M is outputted to the gradation divider 665B so as to generate the $255^{th}$ gradation voltage V<254>. If the switch element Q3 is turned off and the switch element Q4 is turned on, the $256^{th}$ gradation voltage V<255> is outputted to the gradation divider 665B so as to generate the $255^{th}$ gradation voltage V<254>.

The inflection point adjustment circuit 663 includes first thru $M^{th}$ inflection point adjustment switches SW1 thru SWM connected to output lines of gamma buffers A1 thru AM (or output lines of the luminance corrector 661B). Each of the first thru $M^{th}$ inflection point adjustment switches SW1 thru SWM adjusts positions of connection points between the gamma buffers A1 thru AM (or the luminance corrector 661B) and the gradation divider 665B in response to inflection point adjustment signals IPS. Each of the first thru $M^{th}$ inflection point adjustment switches SW1 thru SWM includes one or more switches, each of which forms a connection point with the resistor string 665B, thus outputting a gradation voltage suitable for unique gamma characteristics of respective display panels. For example, the first inflection point adjustment switch SW1 includes first thru third switches, such that the first switch generates the second gradation voltage V<1> by adjusting a position of a connection point with the gradation divider 665B, the second switch generates a third gradation voltage V<2> by adjusting a position of a connection point with the gradation divider 665B, and the third switch generates a fourth gradation voltage V<3> by adjusting a position of a connection point with the gradation divider 665B. The number of inflection point adjustment switches SW1 thru SWM may be set differently from display device to display device.

The inflection point adjustment register 669 outputs the inflection point adjustment signals IPS to the inflection point adjustment circuit 663 through level shifters so as to adjust the inflection point of the gamma curve.

The gradation divider 665B includes a resistor string and changes connection points with the inflection point adjustment circuit 663 so as to adjust the inflection point of the gamma curve, thus generating and outputting the second thru $(N-1)^{th}$ gradation voltages V<1> thru V<N−2> from the first gamma buffer voltage AGV_1 (or the first gradation voltage V<0>) thru the $M^{th}$ gamma buffer voltage AGV_M (or the $256^{th}$ gradation voltage V<255>).

Figure 7:
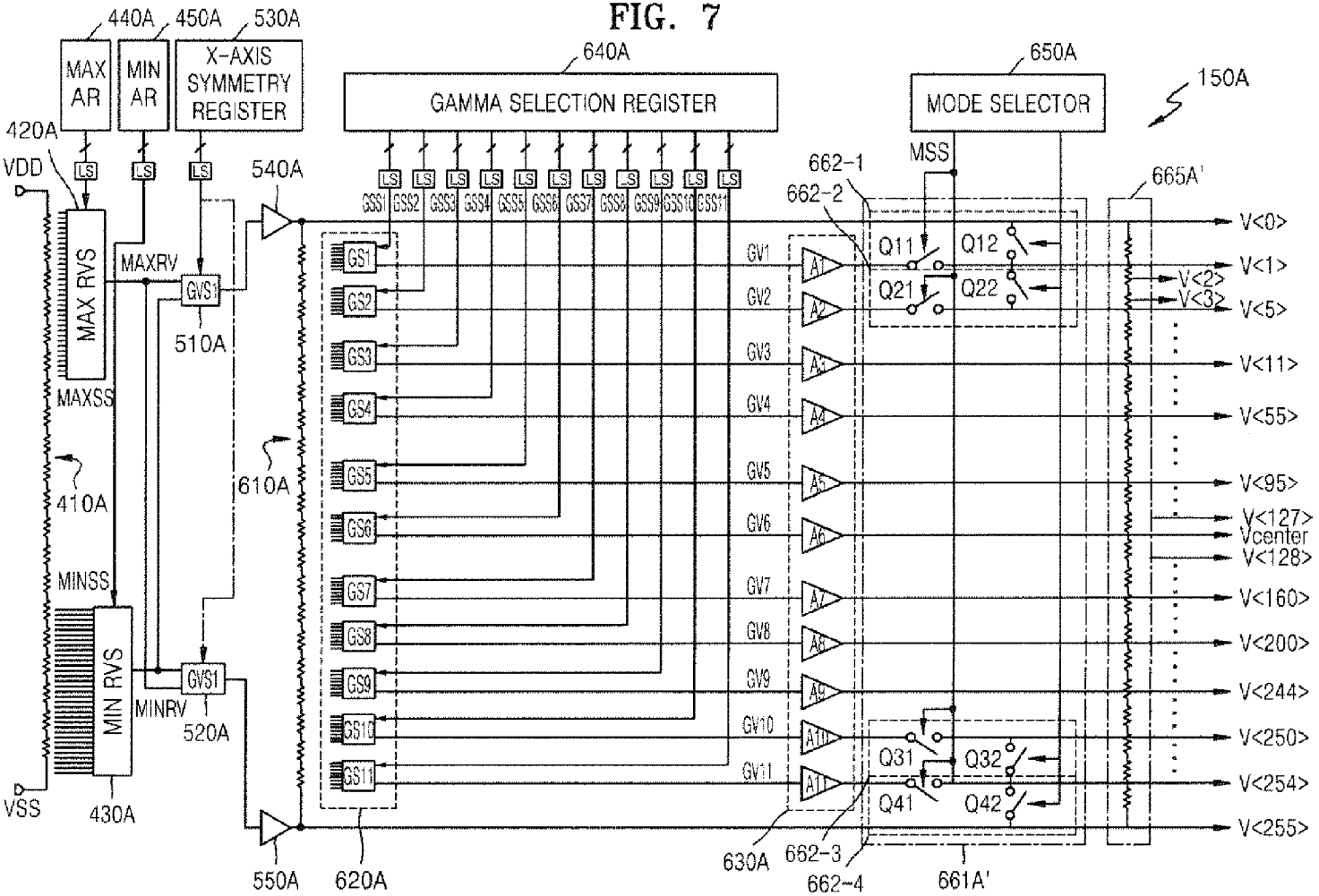
FIG. 7 is a diagram showing a gradation voltage generator according to an embodiment of the present invention.

FIG. 7 is a diagram showing a gradation voltage generator according to an embodiment of the present invention.

Referring to FIG. 7, a power divider 410A generates a plurality of voltages through voltage division between the first power voltage VDD and the second power voltage VSS. The maximum reference voltage selector 420A selects the maximum reference voltage MAXRV from among the first power voltage VDD through the middle voltage VMID in response to the maximum reference voltage signal MAXSS output from the maximum adjustment register 440A, and outputs the maximum reference voltage MAXRV. The minimum reference voltage selector 430A selects the minimum reference voltage MINRV from among the middle power voltage VMID through the second power voltage VSS in response to the minimum reference voltage signal MINSS output from the minimum adjustment register 450A, and outputs the minimum reference voltage MINRV.

A first gradation voltage selector 510A outputs the maximum reference voltage MAXRV or the minimum reference voltage MINRV as the first gradation voltage V<0> in response to the inversion control signal ICS. A second gradation voltage selector 520A outputs the minimum reference voltage MINRV or the maximum reference voltage MAXRV as the $256^{th}$ gradation voltage V<255> in response to the inversion control signal ICS. The X-axis symmetry register 530A outputs the inversion control signal ICS to the first gradation voltage selector 510A and the second gradation voltage selector 520A through level shifters LS, and controls selection performed by the first gradation voltage selector 510A and the second gradation voltage selector 520A.

In the gradation voltage generator 150A shown in FIG. 7, the first gradation voltage selector 510A outputs the first gradation voltage V<0> as the maximum reference voltage MAXRV, and the second gradation voltage selector 520A outputs the $256^{th}$ gradation voltage V<255> as the minimum reference voltage MINRV, and by turns, the first gradation voltage selector 510A outputs the $256^{th}$ gradation voltage V<255> as the maximum reference voltage MAXRV, and the second gradation voltage selector 520A outputs the first gradation voltage V<0> as the minimum reference voltage MINRV, such that the first gradation voltage V<0> and the $256^{th}$ gradation V<255> can be periodically inverted.

A first gradation buffer 540A buffers and outputs the first gradation voltage V<0> (or a first gradation buffer voltage) outputted by the first gradation voltage selector 510A, and a second gradation buffer 550A buffers and outputs the $256^{th}$ gradation voltage V<255> (or a second gradation buffer voltage) outputted by the second gradation voltage selector 520A.

A gamma divider 610A generates a plurality of voltages through voltage division between the first gradation voltage V<0> and the $256^{th}$ gradation voltage V<255>.

The first gamma selector GS1 outputs a voltage corresponding to a first gamma selection signal GSS1 among the plurality of voltages inputted by the gamma divider 610A as the first gamma voltage GV1. The first gamma buffer A1 of a gamma buffering unit 630A buffers the first gamma voltage GV1 output from the first gamma selector GS1, and outputs the buffered first gamma voltage GV1 as the first gamma buffer voltage AGV1=V<1>. The second gamma selector GS2 outputs a voltage corresponding to a second gamma selection signal GSS2 among the plurality of voltages inputted by the gamma divider 610A as the second gamma voltage GV2. The second gamma buffer A2 buffers the second gamma voltage GV2 output from the second gamma selector GS2, and outputs the buffered second gamma voltage GV2 as the second gamma buffer voltage AGV2=V<5>.

The operation of the first gamma selector GS1 and the operation of the second gamma selector GS2 are identically applied to operations of the third gamma selector GS3 thru the eleventh gamma selector GS11, and thus the operations of the third thru eleventh gamma selectors GS3 thru GS11 will not described in detail. The operation of the first gamma buffer A1 and the operation of the second gamma buffer A2 are identically applied to operations of the third gamma buffer A3 thru the eleventh gamma buffer A11, and thus the operations of the third thru eleventh gamma buffers A3 thru A11 will not described in detail.

The embodiment of FIG. 7 shows an example where buffer voltages outputted by buffers are the lowest-gradation voltage V<0>, the highest-gradation voltage V<255>, V<1>, V<5>, V<11>, V<55>, V<95>, V<127>, V<160>, V<200>, V<244>, V<250>, and V<254>, but the present invention is not limited to the foregoing example, and the number and levels of output buffer voltages may set variously.

A gamma adjustment register 640A outputs the first gamma selection signal GSS1 thru the eleventh gamma selection signal GSS11 to the first gamma selector GS1 thru the eleventh gamma selector GS11 through respective level shifters. That is, the gamma adjustment register 640A determines a gamma curve by controlling selection performed by the first thru eleventh gamma selectors GS1 thru GS11.

A mode selector 650A selects a color mode of a liquid crystal panel and controls a luminance corrector 661A' according to the selection result. The color mode may include a 16M color mode expressed with 256 gradations, a 262K color mode expressed with 64 gradations, and a 65K color mode expressed with 32 gradations, and the color mode may be changed by selection of the user.

The luminance corrector 661A' includes first thru fourth switches 662-1 thru 662-4. Each of switch elements Q11 thru Q42 of the luminance corrector 661A' is independently controlled by the mode control signal MSS output from the mode selector 650A.

The first switch 662-1 includes a switch element Q11 connected to an output line of the first gamma buffer A1, and a switch element Q12 connected between an output line for the first gradation voltage V<0> and the output line of the first gamma buffer A1.

The second switch 662-2 includes a switch element Q21 connected to an output line of the second gamma buffer A2, and a switch element Q22 connected between the output line of the first gamma buffer A1 and the output line of the second gamma buffer A2.

The third switch 662-3 includes a switch element Q31 connected to an output line of the tenth gamma buffer A10, and a switch element Q32 connected between the output line of the tenth gamma buffer A10 and the output line of the eleventh gamma buffer A11.

The fourth switch 662-4 includes a switch element Q41 connected to an output line of the eleventh gamma buffer A11, and a switch element Q42 connected between the output line for the 256$^{th}$ gradation voltage V<255> and the output line of the eleventh gamma buffer A11.

When the mode selector 650A selects the 16M color mode, the switch elements Q11, Q21, Q31, and Q41 are turned on and the switch elements Q12, Q22, Q32, and Q42 are turned off, such that gamma buffer voltages outputted by the gamma buffers A1 thru A11 of the gamma buffering unit 630A are inputted to the gradation divider 665A'.

When the mode selector 650A selects the 262K color mode, the switch element Q11 of the first switch 662-1 is turned off and the switch element Q12 of the first switch 662-1 is turned on. In the second switch 662-2, the switch element Q21 is turned on and the switch element Q22 is turned off. In the third switch 662-3, the switch element Q31 is turned on and the switch element Q32 is turned off. In the fourth switch 662-4, the switch element Q41 is turned off and the switch element Q42 is turned on. Thus, the first gradation voltage V<0> is outputted as the second gradation voltage V<1> so as to compensate for luminance in low gradations, and the 256$^{th}$ gradation voltage V<255> is outputted as the 255$^{th}$ gradation voltage V<254> so as to compensate for luminance in high gradations.

When the mode selector 650A selects the 65K color mode, the switch element Q11 of the first switch 662-1 is turned off and the switch element Q12 of the first switch 662-1 is turned on. In the second switch 662-2, the switch element Q21 is turned off and the switch element Q22 is turned on. In the third switch 662-3, the switch element Q31 is turned off and the switch element Q32 is turned on. In the fourth switch 662-4, the switch element Q41 is turned off and the switch element Q42 is turned on. Thus, the first gradation voltage V<0> is outputted as the sixth gradation voltage V<5> so as to compensate for luminance in low gradations, and the 256$^{th}$ gradation voltage V<255> is outputted as the 251$^{st}$ gradation voltage V<250> so as to compensate for luminance in high gradations.

The gradation divider 665A' generates the second gradation voltage V<1> thru the 255$^{th}$ gradation voltage V<254> through voltage division between the first gamma buffer voltage AGV_1 (or the first gradation voltage V<0>) thru the eleventh gamma buffer voltage AGV11 (or the 256$^{th}$ gradation voltage (V<255>). For example, in FIG. 7, the gradation divider 665A' generates the third gradation voltage V<2> thru the fifth gradation voltage V<4> through voltage division between the second gradation voltage V<1>, which is the first gamma buffer voltage, and the sixth gradation voltage V<5>, which is the second gamma buffer voltage. Also in FIG. 7, the gradation divider 665A' generates the seventh gradation voltage V<6> thru the eleventh gradation voltage V<10> through voltage division between the sixth gradation voltage V<5>, which is the second gamma buffer voltage, and the twelfth gradation voltage V<11>, which is the third gamma buffer voltage.

Hereinafter, the operation of the luminance corrector 661A' will be described with reference to FIG. 8.

FIG. 8 is a diagram showing a match relationship between gradation voltages and image data bits according to color modes.

Referring to FIG. 8, 8-bit image data expresses first thru 256$^{th}$ gradations in the 16M color mode, 6-bit image data expresses first thru 64$^{th}$ gradations in the 262K color mode, and 5-bit image data expresses first thru 32$^{nd}$ gradations in the 65K color mode. In the 262K color mode, least significant 2 bits of 8 bits are not used or set to "00" or "11"; in the 65K color mode, least significant 3 bits of 8 bits are not used or set to "000" or "111".

Upon input of image data of predetermined bits, a corresponding gradation voltage is selected.

For the sake of convenience, buffer voltages will be set to V<0>, V<1>, V<5>, V<11>, V<55>, V<95>, V<127>, V<160>, V<200>, V<244>, V<250>, V<254>, and V<255>, but the present invention is not limited thereto.

In the 16M color mode, a gradation voltage and image data bits have a one-to-one matching relationship. Thus, the switch elements Q11, Q21, Q31, and Q41 are turned on and the switch elements Q12, Q22, Q32, and Q42 are turned off, such that gamma buffer voltages output from the gamma buffers A1 thru A11 are inputted to the gradation divider 665A'. The gradation divider 665A' generates the second gradation voltage V<1> thru the 255$^{th}$ gradation voltage V<254> through voltage division between gamma buffer voltages. For example, input image data "00000100" is the fifth gradation, and thus the fifth gradation voltage V<4> corresponding thereto is selected. The fifth gradation voltage V<4> is generated by voltage division between the second gradation voltage V<1>, which is the first gamma buffer voltage, and the sixth gradation voltage V<5>, which is the second gamma buffer voltage.

In the 262K color mode, most significant 6 bits, except for least significant 2 bits, of input image data are used. Thus, the first thru fourth gradations of the 16M color mode correspond to the first gradation of the 262K color mode, and the 253$^{th}$ thru 256$^{th}$ gradations of the 16M color mode correspond to the 64$^{th}$ gradation of the 262K color mode. The first thru fourth gradations of the 16M color mode have the same luminance in the 262K color mode, and likewise, the 256$^{th}$ thru 253$^{rd}$ gradations of the 16M color mode have the same luminance in the 262K color mode. Hence, when the fifth gradation voltage V<4> is generated by voltage division between the second gradation voltage V<1> and the sixth gradation voltage V<5>, the use of the second gradation voltage V<1> for generation of the fifth gradation voltage V<4> may lead to degradation of luminance in high gradations. Likewise, when the 252$^{nd}$ gradation voltage V<251> is generated by voltage division between the 255$^{th}$ gradation voltage V<254> and the 251$^{st}$ gradation voltage V<250>, the use of the 255$^{th}$ gradation voltage V<254> for generation of the 253rd gradation voltage V<252> may lead to degradation of luminance in high gradations.

Thus, the switch elements Q11, Q22, Q32, and Q41 are turned off and the switch elements Q12, Q21, Q31, and Q42 are turned on, thus compensating for luminance in low gradations by using the first gradation voltage V<0> as the second gradation voltage V<1>, and compensating for luminance in high gradations by using the 256$^{th}$ gradation voltage V<255> as the 255$^{th}$ gradation voltage V<254>. For example, input image data "00000100" is determined as the second gradation of "000001" excluding least significant 2 bits from "00000100", and thus the fifth gradation voltage V<4> corresponding thereto is selected. The fifth gradation voltage <V4> is generated by voltage division between the second gradation voltage V<1> having a level of the first gradation voltage V<0> and the sixth gradation voltage V<5>.

In the 65K color mode, most significant 5 bits, except for least significant 3 bits, of input image data are used. Thus, the first thru eighth gradations of the 16M color mode correspond to the first gradation of the 65K color mode, and the 249$^{th}$ thru 256$^{th}$ gradations of the 16M color mode correspond to the 32$^{nd}$ gradation of the 262K color mode. The first thru eighth gradations of the 16M color mode have the same luminance in the 65K color mode, and likewise, the 256$^{th}$ thru 249$^{th}$ gradations of the 16M color mode have the same luminance in the 65K color mode. Hence, when the ninth gradation voltage V<8> is generated by voltage division between the sixth gradation voltage V<5> and the twelfth gradation voltage V<11>, the use of the second gradation voltage V<1> or the sixth gradation voltage V<5> for generation of the ninth gradation voltage V<8> may lead to degradation of luminance in low gradations. Similarly, when the 249$^{th}$ gradation voltage V<248> is generated by voltage division between the 251$^{st}$ gradation voltage V<250> and the 245$^{th}$ gradation voltage V<244>, the use of the 255$^{th}$ gradation voltage V<254> or the 251$^{st}$ gradation voltage V<250> for generation of the 249$^{th}$ gradation voltage V<248> may lead to degradation of luminance in high gradations.

Thus, the switch elements Q11, Q21, Q31, and Q41 are turned off and the switch elements Q12, Q22, Q32, and Q42 are turned on, thus compensating for luminance in low gradations by using the first gradation voltage V<0> as the sixth gradation voltage V<5>, and compensating for luminance in high gradations by using the 256$^{th}$ gradation voltage V<255> as the 251$^{st}$ gradation voltage V<250>. For example, input image data "00001000" is determined as the second gradation of "00001" excluding least significant 3 bits from "00001000", and thus the ninth gradation voltage V<8> corresponding thereto is selected. The ninth gradation voltage <V8> is generated by voltage division between the sixth gradation voltage V<5> having a level of the first gradation voltage V<0> and the twelfth gradation voltage V<11>.

Figure 9:
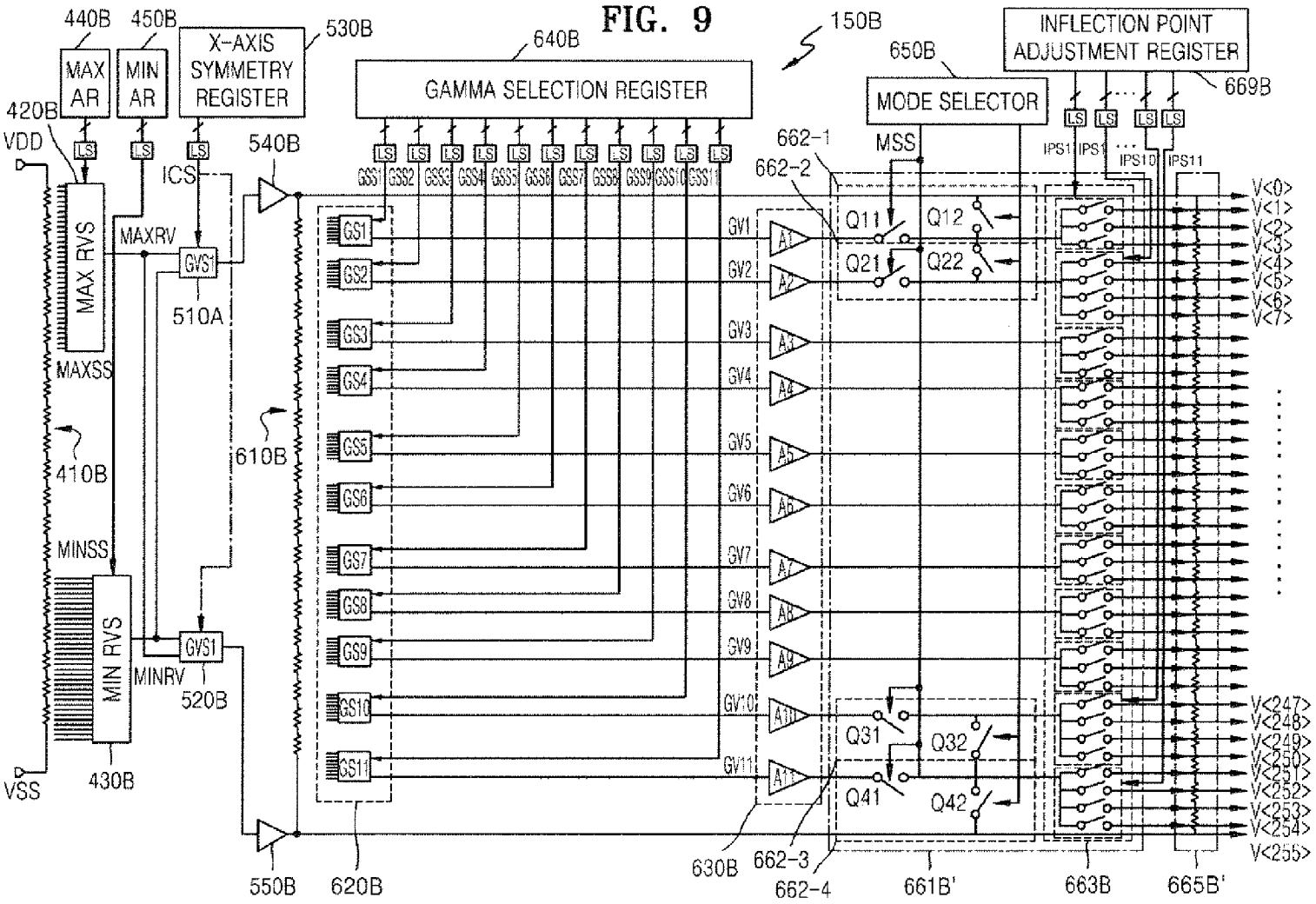
FIG. 9 is a diagram showing a gradation voltage generator according to another embodiment of the present invention.

FIG. 9 is a diagram showing a gradation voltage generator according to another embodiment of the present invention.

The gradation voltage generator 150B of FIG. 9 is different from the gradation voltage generator 150A of FIG. 7 in that an inflection point adjustment circuit 663B and an inflection adjustment register 669B are added. The other components are the same as those disclosed in FIG. 7, and thus will not be described in detail.

The inflection point adjustment circuit 663B includes a plurality of first thru eleventh inflection point adjustment switches SW1 thru SW11. The inflection point adjustment switches SW1 thru SW11 are provided at output lines of gamma buffers A1 thru A11, respectively, of a gamma buffering unit 630B. The number of switch elements included in each inflection adjustment switch SW may be set differently. The inflection point adjustment switches SW1 thru SW11 adjust positions of connection points between the gamma buffers A1 thru A11 and the gradation divider 665B' in response to inflection point adjustment signals IPS1 thru IPS11, respectively. The inflection point adjustment register 669B outputs the inflection point adjustment signals IPS1 thru IPS11 to the inflection point adjustment switches SW1 thru SW11, respectively, through level shifters, thereby adjusting an inflection point of a gamma curve.

Each display panel has its unique gamma characteristics, and to achieve optimal display quality for each color mode, proper division of gamma buffer voltages for each of R/G/B is necessary. Hence, if an inflection point of a gamma curve is adjusted by using the inflection point adjustment switches SW1 thru SW11 and the inflection point adjustment register 669B, a gamma curve suitable for each display panel can be provided. Thus, gamma buffer voltages outputted from the gamma buffering unit 630B through the inflection point adjustment switches SW1 thru SW11 can be outputted as a plurality of gradation voltages according to the type of display panel and the color mode.

While the number of switch elements included in each inflection point adjustment switch is set to 3 or 4 for the sake of convenience in the embodiment show in FIG. 9, the present invention is not limited thereto, and the number of switch elements may be set differently according to the gap between gradation voltages and voltage levels.

Hereinafter, the operations of the luminance corrector 661W, the inflection point adjustment circuit 663B, and the gradation divider 665B' will be described with reference to FIG. 8.

In the 16M color mode, the switch elements Q11, Q21, Q31, and Q41 are turned on and the switch elements Q12, Q22, Q32, and Q42 are turned off, such that gamma buffer voltages outputted by the gamma buffers A1 thru A11 are inputted to the gradation divider 665W. The first gamma buffer voltage output from the first gamma buffer A1 is outputted as the second gradation voltage V<1> thru the fourth gradation voltage V<3> through the first inflection point adjustment switch SW1. The second gamma buffer voltage output from the second gamma buffer A2 is outputted as the fifth gradation voltage V<4> thru the eighth gradation voltage V<7> through the second inflection point adjustment switch SW2. The operations of the third thru eleventh gamma buffers A3 thru A11 and the operations of the third thru eleventh inflection point adjustment switches SW3 thru SW11 are the same as those of the first and second gamma buffers A1 and A2 and the first and second inflection point adjustment switches SW1 and SW2, respectively, and thus will not be described in detail.

In the 262K color mode, the switch elements Q11, Q22, Q32, and Q41 are turned off and the switch elements Q12, Q21, Q31, and Q42 are turned on, thus compensating for luminance in low gradations by using the first gradation voltage V<0> as the second gradation voltage V<1>, and compensating for luminance in high gradations by using the 256$^{th}$ gradation voltage V<255> as the 255$^{th}$ gradation voltage V<254>. The first gradation voltage V<0> is outputted as the second thru fourth gradation voltages V<1> thru V<3> through the first inflection point adjustment switch SW1. The 256$^{th}$ gradation voltage V<255> is outputted as the 255$^{th}$ thru 252$^{nd}$ gradation voltages V<254> thru V<251> through the eleventh inflection point adjustment switch SW11. The second gamma buffer voltage output from the second gamma buffer A2 is outputted as the fifth thru eighth gradation voltages V<4> thru V<7> through the second inflection point adjustment switch SW2. The operations of the third thru tenth gamma buffers A3 thru A10 and the operations of the third through tenth inflection point adjustment switches SW3 thru SW10 are the same as the operation of the second gamma buffer A2 and the operation of the second inflection point adjustment switch SW2, respectively, and thus will not be described in detail. The number of switch elements included in each inflection point adjustment switch may be set variously.

In the 65K color mode, the switch elements Q11, Q22, Q32, and Q41 are turned off and the switch elements Q12, Q21, Q31, and Q42 are turned on, thus compensating for luminance in low gradations by using the first gradation voltage V<0> as the second gradation voltage V<1> and compensating for luminance in high gradations by using the 256$^{th}$ gradation voltage V<255> as the 255$^{th}$ gradation voltage V<254>. The first gradation voltage V<0> is outputted as the fifth thru eighth gradation voltages V<4> thru V<7> through the second inflection point adjustment switch SW2. The 256$^{th}$ gradation voltage V<255> is outputted as the 251$^{st}$ thru 248$^{th}$ gradation voltages V<250> thru V<247> through the tenth inflection point adjustment switch SW10. The third gamma buffer voltage output from the third gamma buffer A3 is outputted as the ninth thru eleventh gradation voltages V<8> thru V<10> through the third inflection point adjustment switch SW3. The operations of the fourth thru ninth gamma buffers A4 thru A9 and the operations of the fourth thru ninth inflection point adjustment switches SW4 thru SW9 are the same as those of the third gamma buffer A3 and the third inflection point adjustment switch SW3, respectively, and thus will not be described in detail. The number of switch elements included in each inflection point adjustment switch may be set variously.

Needless to say, the technical spirit of the present invention can be extended to various applications, such as a computer, a note book, a cellular phone, and the like where a display device is used.

While the present invention has been described based on multi-gradation implementation which selectively expresses the 16M color mode expressed with 256 gradations, the 262K color mode expressed with 64 gradations, and the 65K color mode expressed with 32 gradations, the present invention is not limited thereto, and may be identically applied to multi-gradation implementation including gradations higher than 256 gradations, such as 512 gradations, 1024 gradations, or the like, and gradations lower than 32 gradations, such as 16 gradations, 8 gradations, or the like. The present invention may generate a gradation voltage suitable for gamma characteristics which vary by liquid crystal panel type. In addition, the present invention can minimize gradation mismatch between color modes, even when different color modes are used by different users. Therefore, it is possible to rapidly handle color mode change and correct optical characteristics. Moreover, gradation linearity, color temperature, and flicker of a liquid crystal panel can be optimized.

While the present invention has been particularly shown and described with reference to an exemplary embodiment thereof, they are provided for the purposes of illustration, and it will be understood by those of ordinary skill in the art that various modifications and equivalent other embodiments can be made from the present invention. Accordingly, the true technical scope of the present invention should be defined by the technical spirit of the appended claims.

What is claimed is:

1. A gamma voltage controller, comprising:

a gamma divider generating a plurality of voltages through voltage division between a first gradation voltage and an $N^{th}$ gradation voltage;

a gamma selection unit including first through $M^{th}$ gamma selectors which select first through $M^{th}$ gamma voltages from among the plurality of voltages, and outputting the selected first through $M^{th}$ gamma voltages;

a gamma buffering unit buffering the selected first through $M^{th}$ gamma voltages, and outputting first through $M^{th}$ gamma buffer voltages;

a mode selector selecting a color mode of a display panel; and a gradation controller responding in correspondence with the selected color mode and compensating for luminance in high gradations and luminance in low gradations by selecting one of the first gamma buffer voltage or the first gradation voltage and selecting one of the $M^{th}$ gamma buffer voltage or the $N^{th}$ gradation voltage, and by generating second through $(N-1)^{th}$ gradation voltages.

2. The gamma voltage controller of claim 1, wherein the gradation controller comprises:

a switch blocking the first gamma buffer voltage and the $M^{th}$ gamma buffer voltage, and outputting the first gradation voltage and the $N^{th}$ gradation voltage; and a gradation divider generating the second through $(N-1)^{th}$ gradation voltages by using the first gradation voltage and the $N^{th}$ gradation voltage.

3. The gamma voltage controller of claim 2, wherein the switch blocks some of the first through $M^{th}$ gamma buffer voltages if a color mode of a lower gradation than a color mode of a gradation set by default is selected.

4. The gamma voltage controller of claim 1, wherein the gradation controller comprises:

a switch selecting one of the first gamma buffer voltage and the first gradation voltage, and one of the $M^{th}$ gamma buffer voltage and the $N^{th}$ gradation voltage; and a gradation divider generating the second through $(N-1)^{th}$ gradation voltages by the selected voltages, wherein the switch comprises:

a first switch element connected to an output line for the first gamma buffer voltage;

a second switch element connected to the output line for the first gamma buffer voltage and to an output line for the first gradation voltage;

a third switch element connected to an output line for the $M^{th}$ gamma buffer voltage; and a fourth switch element connected to the output line for the $M^{th}$ gamma buffer voltage and to an output line for the $N^{th}$ gradation voltage.

5. The gamma voltage controller of claim 1, wherein the gradation controller comprises:

a switch selecting one of the first gamma buffer voltage and the second gamma buffer voltage and the first gradation voltage, and one of the $M^{th}$ gamma buffer voltage and an $(M-1)^{th}$ gamma buffer voltage and the $N^{th}$ gradation voltage; and a gradation divider generating the second through (N−1)th gradation voltages by the selected voltages, wherein the switch comprises:

a first switch element connected to an output line for the first gamma buffer voltage;

a second switch element connected to the output line for the first gamma buffer voltage and to an output line for the first gradation voltage;

a third switch element connected to an output line for the $M^{th}$ gamma buffer voltage;

a fourth switch element connected to the output line for the $M^{th}$ gamma buffer voltage and to an output line for the Nth gradation voltage;

a fifth switch element connected to an output line for the second gamma buffer voltage;

a sixth switch element connected to the output line for the second gamma buffer voltage and to the output line for the first gamma buffer voltage;

a seventh switch element connected to an output line for the $(M-1)^{th}$ gamma buffer voltage; and an eighth switch element connected to the output line for the $(M-1)^{th}$ gamma buffer voltage, and to the output line for the $M^{th}$ gamma buffer voltage.

6. The gamma voltage controller of claim 2, further comprising first through $M^{th}$ inflection point adjustment switches adjusting an inflection point of a gamma curve by selecting a connection point with the gradation divider.

7. The gamma voltage controller of claim 6, further comprising an inflection point adjustment register outputting inflection point adjustment signals to the first through $M^{th}$ inflection point adjustment switches.

8. The gamma voltage controller of claim 1, wherein the color mode includes a 16M color mode expressed with 256 gradations, a 262K color mode expressed with 64 gradations, and a 65K color mode expressed with 32 gradations.

9. A gradation voltage generator, comprising:

a reference voltage selector selecting a maximum reference voltage and a minimum reference voltage from among a plurality of voltages divided between a first power voltage and a second power voltage, and outputting the selected maximum reference voltage and minimum reference voltage;

a gradation voltage selector outputting one of the maximum reference voltage and the minimum reference voltage as a first gradation voltage and the other of the maximum reference voltage and the minimum reference voltage as an $N^{th}$ gradation voltage; and a gamma voltage controller selecting first through $M^{th}$ gamma voltages from among a plurality of voltages generated by voltage division between the first gradation voltage and the $N^{th}$ gradation voltage, selecting one of a first gamma buffer voltage or the first gradation voltage and selecting one of an $M^{th}$ gamma buffer voltage or the $N^{th}$ gradation voltage, and generating second through $(N-1)^{th}$ gradation voltages, so as to compensate for luminance in high gradations and luminance in low gradations in accordance with a color mode of a display panel.

10. The gradation voltage generator of claim 9, wherein the gamma voltage controller comprises:

a gamma divider generating the plurality of voltages through voltage division between the first gradation voltage and the $N^{th}$ gradation voltage;

a gamma selection unit including first through $M^{th}$ gamma selectors which select the first through $M^{th}$ gamma voltages from among the plurality of voltages, and outputting the selected first through $M^{th}$ gamma voltages;

a gamma buffering unit buffering the first through $M^{th}$ gamma voltages, and outputting the first through $M^{th}$ gamma buffer voltages;

a mode selector selecting a color mode of the display panel; and a gradation controller selecting one of the first gamma buffer voltage and the first gradation voltage and one of the $M^{th}$ gamma buffer voltage and the $N^{th}$ gradation voltage, and generating second through $(N-1)^{th}$ gradation voltages.

11. The gradation voltage generator of claim 10, wherein the gradation controller comprises:

a switch blocking the first gamma buffer voltage and the $M^{th}$ gamma buffer voltage, and outputting the first gradation voltage and the $N^{th}$ gradation voltage; and a gradation divider generating the second through $(N-1)^{th}$ gradation voltages by using the first gradation voltage and the $N^{th}$ gradation voltage.

12. The gradation voltage generator of claim 11, wherein the switch blocks some of the first through $M^{th}$ gamma buffer voltages if a color mode of a lower gradation than a color mode of a gradation set by default is selected.

13. The gradation voltage generator of claim 9, wherein the gradation controller comprises:

a switch selecting one of the first gamma buffer voltage and the first gradation voltage, and one of the $M^{th}$ gamma buffer voltage and the $N^{th}$ gradation voltage; and a gradation divider generating the second through $(N-1)^{th}$ gradation voltages by the selected voltages, wherein the switch comprises:

a first switch element connected to an output line for the first gamma buffer voltage;

a second switch element connected to the output line for the first gamma buffer voltage and to an output line for the first gradation voltage;

a third switch element connected to an output line for the $M^{th}$ gamma buffer voltage; and a fourth switch element connected to the output line for the $M^{th}$ gamma buffer voltage and to an output line for the $N^{th}$ gradation voltage.

14. The gradation voltage generator of claim 9, wherein the gradation controller comprises:

a switch selecting one of the first gamma buffer voltage and the second gamma buffer voltage and the first gradation voltage, and one of the $M^{th}$ gamma buffer voltage and an $(M-1)^{th}$ gamma buffer voltage and the $N^{th}$ gradation voltage; and a gradation divider generating the second through $(N-1)^{th}$ gradation voltages by the selected voltages, wherein the switch comprises:

a first switch element connected to an output line for the first gamma buffer voltage;

a second switch element connected to the output line for the first gamma buffer voltage and to an output line for the first gradation voltage;

a third switch element connected to an output line for the $M^{th}$ gamma buffer voltage;

a fourth switch element connected to the output line for the $M^{th}$ gamma buffer voltage and to an output line for the $N^{th}$ gradation voltage;

a fifth switch element connected to an output line for the second gamma buffer voltage;

a sixth switch element connected to the output line for the second gamma buffer voltage and to the output line for the first gamma buffer voltage;

a seventh switch element connected to an output line for the $(M-1)^{th}$ gamma buffer voltage; and an eighth switch element connected to the output line for the $(M-1)^{th}$ gamma buffer voltage and to the output line for the $M^{th}$ gamma buffer voltage.

15. The gradation voltage generator of claim 11, further comprising:

first through $M^{th}$ inflection point adjustment switches adjusting an inflection point of a gamma curve by selecting a connection point with the gradation divider; and an inflection point adjustment register outputting inflection point adjustment signals to the first through $M^{th}$ inflection point adjustment switches.

16. The gradation voltage generator of claim 9, wherein the color mode comprises a 16M color mode expressed with 256 gradations, a 262K color mode expressed with 64 gradations, and a 65K color mode expressed with 32 gradations.

17. A display device, comprising:

a display panel;

a source driver connected to a plurality of data lines of the display panel and supplying a data voltage to the plurality of data lines; and a gradation voltage generator generating a first gradation voltage and an Nth gradation voltage based on a first power voltage and a second power voltage, generating second through $(N-1)^{th}$ gradation voltages based on first through $M^{th}$ gamma voltages generated by voltage division between the first gradation voltage and the $N^{th}$ gradation voltage, correcting luminance in high gradations and luminance in low gradations in accordance with a color mode of the display panel, and providing the first through $N^{th}$ gradation voltages to the source driver, the gradation voltage generator comprising:

a reference voltage selector selecting a maximum reference voltage and a minimum reference voltage from among a plurality of voltages divided between the first power voltage and the second power voltage, and outputting the selected maximum reference voltage and minimum reference voltage;

a gradation voltage selector outputting the first gradation voltage as the maximum reference voltage and the $N^{th}$ gradation voltage as the minimum reference voltage; and a gamma voltage controller responding in correspondence with the color mode of the display panel and compensating for luminance in high gradations and luminance in low gradations by selecting first through $M^{th}$ gamma voltages from among the plurality of voltages generated by voltage division between the first gradation voltage and the $N^{th}$ gradation voltage, selecting one of a first gamma buffer voltage or the first gradation voltage and selecting one of an $M^{th}$ gamma buffer voltage or the $N^{th}$ gradation voltage, and by generating second through $(N-1)^{th}$ gradation voltages.

18. The display device of claim 17, wherein the gamma voltage controller comprises:

a gamma divider generating the plurality of voltages through voltage division between the first gradation voltage and the $N^{th}$ gradation voltage;

a gamma selection unit including first through $M^{th}$ gamma selectors which select the first through $M^{th}$ gamma voltages from among the plurality of voltages, and outputting the selected first through $M^{th}$ gamma voltages;

a gamma buffering unit buffering the first through $M^{th}$ gamma voltages, and outputting the first through $M^{th}$ gamma buffer voltages;

a mode selector selecting the color mode of the display panel; and a gradation controller selecting one of the first gamma buffer voltage and the first gradation voltage and one of the $M^{th}$ gamma buffer voltage and the $N^{th}$ gradation voltage, and generating second through $(N-1)^{th}$ gradation voltages.

19. The display device of claim 18, wherein the gradation controller comprises:

a switch blocking the first gamma buffer voltage and the $M^{th}$ gamma buffer voltage, and outputting the first gradation voltage and the $N^{th}$ gradation voltage; and a gradation divider generating the second through $(N-1)^{th}$ gradation voltages by using the first gradation voltage and the $N^{th}$ gradation voltage.

20. The display device of claim 19, wherein the switch blocks some of the first through $M^{th}$ gamma buffer voltages if a color mode of a lower gradation than a color mode of a gradation set by default is selected.

21. The display device of claim 19, wherein the switch comprises:

a first switch element connected to an output line for the first gamma buffer voltage;

a second switch element connected to the output line for the first gamma buffer voltage and to an output line for the first gradation voltage;

a third switch element connected to an output line for the $M^{th}$ gamma buffer voltage; and a fourth switch element connected to the output line for the $M^{th}$ gamma buffer voltage and to an output line for the $N^{th}$ gradation voltage.

22. The display device of claim 21, wherein the gradation controller selects one of the first gamma buffer voltage and the second gamma buffer voltage and the first gradation voltage, and one of the $M^{th}$ gamma buffer voltage and an (M−1) th gamma buffer voltage and the $N^{th}$ gradation voltage, so as to generate the second through $(N-1)^{th}$ gradation voltages, and wherein the switch further comprises:

a fifth switch element connected to an output line for the second gamma buffer voltage;

a sixth switch element connected to the output line for the second gamma buffer voltage and to the output line for the first gamma buffer voltage;

a seventh switch element connected to an output line for the $(M-1)^{th}$ gamma buffer voltage; and an eighth switch element connected to the output line for the $(M-1)^{th}$ gamma buffer voltage and to the output line for the $M^{th}$ gamma buffer voltage.

23. The display device of claim 19, further comprising:

first through $M^{th}$ inflection point adjustment switches adjusting an inflection point of a gamma curve by selecting a connection point with the gradation divider; and an inflection point adjustment register outputting inflection point adjustment signals to the first through $M^{th}$ inflection point adjustment switches.

24. The display device of claim 17, wherein the color mode comprises a 16M color mode expressed with 256 gradations, a 262K color mode expressed with 64 gradations, and a 65K color mode expressed with 32 gradations.

* * * * *